US010850181B2

(12) United States Patent
Restko et al.

(10) Patent No.: US 10,850,181 B2
(45) Date of Patent: Dec. 1, 2020

(54) BATTING GLOVE AND CUSHIONING APPARATUS

(71) Applicants: Jason T. Restko, Tinley Park, IL (US); Leonard J. Stubenfoll, Orland Park, IL (US); David J. Payton, Orland Park, IL (US)

(72) Inventors: Jason T. Restko, Tinley Park, IL (US); Leonard J. Stubenfoll, Orland Park, IL (US); David J. Payton, Orland Park, IL (US)

(73) Assignee: Jax Athletics, LLC, Tinley Park, IL (US)

( * ) Notice: Subject to any disclaimer, the term of this patent is extended or adjusted under 35 U.S.C. 154(b) by 213 days.

(21) Appl. No.: 14/986,728

(22) Filed: Jan. 4, 2016

(65) Prior Publication Data

US 2016/0375344 A1 Dec. 29, 2016

Related U.S. Application Data

(60) Provisional application No. 62/099,352, filed on Jan. 2, 2015.

(51) Int. Cl.
*A63B 71/14* (2006.01)
*A41D 19/015* (2006.01)
(Continued)

(52) U.S. Cl.
CPC ..... *A63B 71/143* (2013.01); *A41D 19/002* (2013.01); *A41D 19/01558* (2013.01); *A63B 69/0002* (2013.01); *A63B 69/0024* (2013.01); *A63B 69/0059* (2013.01); *A41D 19/01523* (2013.01); *A63B 59/50* (2015.10);
(Continued)

(58) Field of Classification Search
CPC ..... A63B 71/143; A63B 71/146; A63B 2069/0008; A63B 69/0002; A63B 69/0024; A63B 69/0059; A63B 2102/02; A63B 2102/14; A63B 2102/182; A63B 2102/24; A63B 2102/22; A63B 2102/32; A63B 2102/18; A63B 59/50; A63B 60/00; A41D 19/002; A41D 19/01558; A41D 19/01547; A41D 19/01523
USPC .... 2/160, 161.1, 163, 159, 169, 16, 19, 168, 2/20
See application file for complete search history.

(56) References Cited

U.S. PATENT DOCUMENTS 2,521,488 A 9/1950 Smith
4,295,229 A * 10/1981 Clark ..... A63B 71/148 2/161.1
(Continued)

FOREIGN PATENT DOCUMENTS

EP 0293526 A1 12/1988
KR 200348492 Y1 4/2004

*Primary Examiner* — Nathan E Durham
*Assistant Examiner* — Abby M Spatz
(74) *Attorney, Agent, or Firm* — Schacht Law Office, Inc.; Paul J. Nykaza

(57) ABSTRACT

A batting glove (10) has a cover member (12) defining a central opening and a plurality of finger elements (20) including a forefinger element (24) and a thumb element (22). The batting glove (10) has a web member (14) generally positioned between the finger element (20) and the thumb element (22). The web member (14) minimizes force against a thenar region of a wearer's hand from a bat in response to hitting a ball with the bat.

13 Claims, 9 Drawing Sheets

(51) Int. Cl.

| | |
|---|---|
| ***A41D 19/00*** | (2006.01) |
| ***A63B 69/00*** | (2006.01) |
| ***A63B 102/18*** | (2015.01) |
| ***A63B 59/50*** | (2015.01) |
| *A63B 102/02* | (2015.01) |
| *A63B 102/14* | (2015.01) |
| *A63B 102/24* | (2015.01) |
| *A63B 102/22* | (2015.01) |
| *A63B 102/32* | (2015.01) |

(52) U.S. Cl.
CPC ... *A63B 2069/0008* (2013.01); *A63B 2102/02* (2015.10); *A63B 2102/14* (2015.10); *A63B 2102/18* (2015.10); *A63B 2102/182* (2015.10); *A63B 2102/22* (2015.10); *A63B 2102/24* (2015.10); *A63B 2102/32* (2015.10)

(56) References Cited

U.S. PATENT DOCUMENTS

| | | | | |
|---|---|---|---|---|
| 4,987,611 | A | 1/1991 | Maye | |
| 5,884,329 | A | 3/1999 | Goldsmith et al. | |
| 5,987,646 | A | 11/1999 | Bolmer | |
| 5,996,117 | A | 12/1999 | Goldsmith et al. | |
| 6,389,601 | B2 | 5/2002 | Kleinert | |
| 6,427,246 | B1 * | 8/2002 | Doi | A41D 19/01588 2/161.1 |
| 6,654,965 | B2 * | 12/2003 | Hochmuth | A63B 71/148 2/161.1 |
| 2004/0068777 | A1 * | 4/2004 | Wheelington, II | A63B 71/143 2/161.1 |
| 2006/0218689 | A1 * | 10/2006 | Brown | A63B 71/143 2/19 |
| 2008/0235842 | A1 | 10/2008 | Patel et al. | |
| 2011/0173733 | A1 * | 7/2011 | Krzeminski | A63B 71/143 2/16 |
| 2012/0117703 | A1 | 5/2012 | Jaramillo et al. | |
| 2012/0284892 | A1 | 11/2012 | Szurley et al. | |
| 2013/0061368 | A1 * | 3/2013 | Filippone | A41D 19/0024 2/160 |
| 2014/0182047 | A1 * | 7/2014 | Silkoff | A63B 71/141 2/169 |
| 2015/0313298 | A1 * | 11/2015 | Bailey | A63B 71/148 2/168 |

* cited by examiner

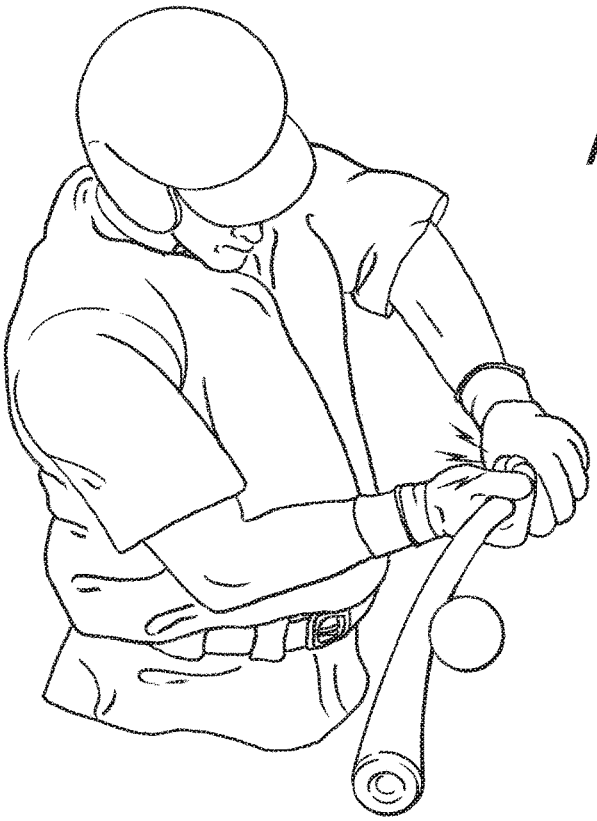
FIG. 1
FIG. 2
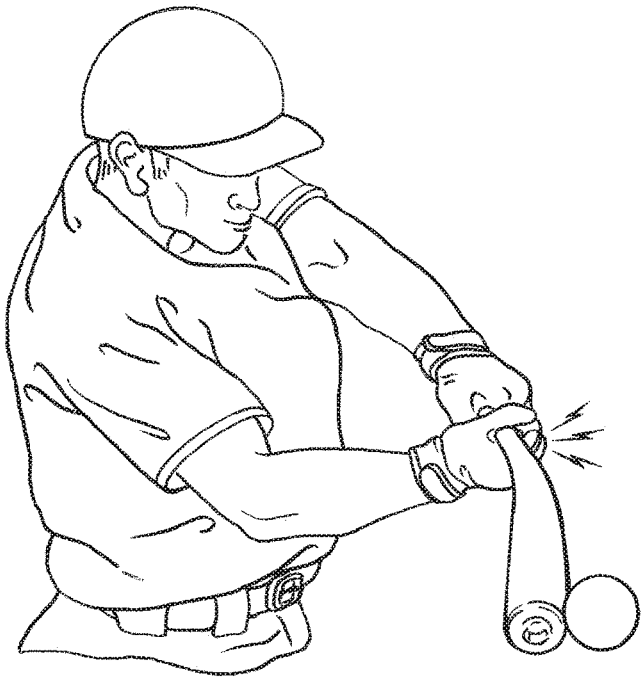

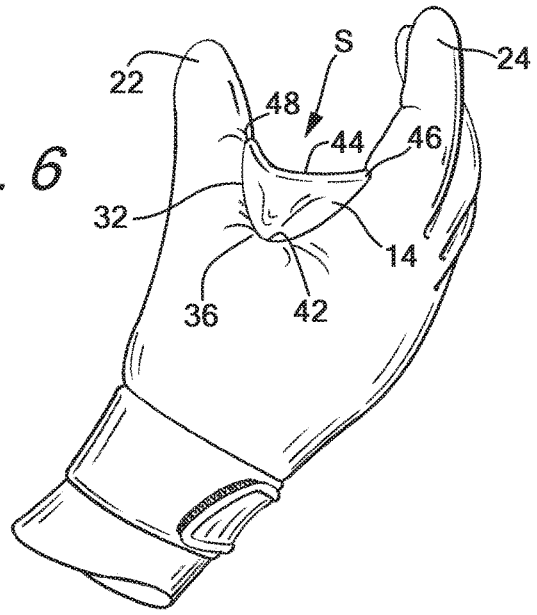
FIG. 6
FIG. 7
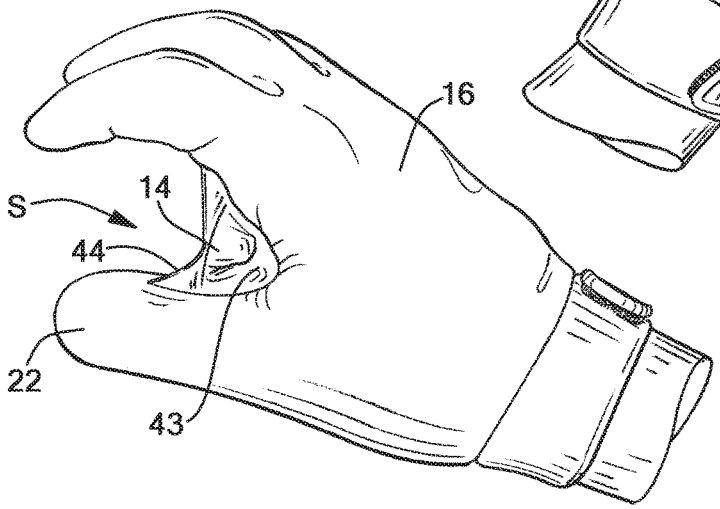
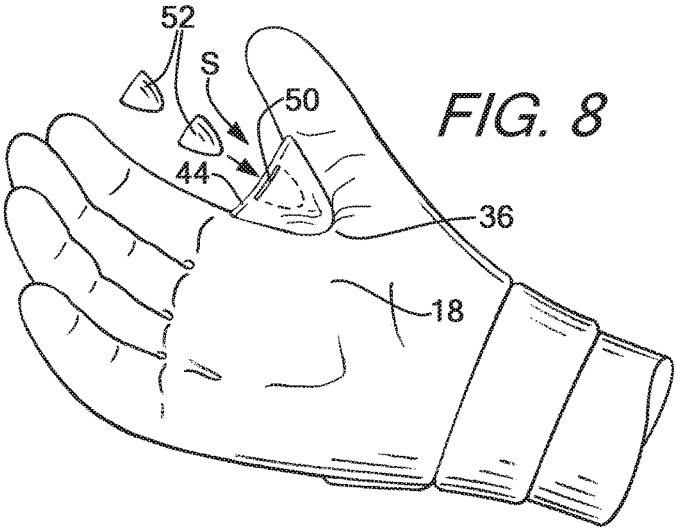
FIG. 8

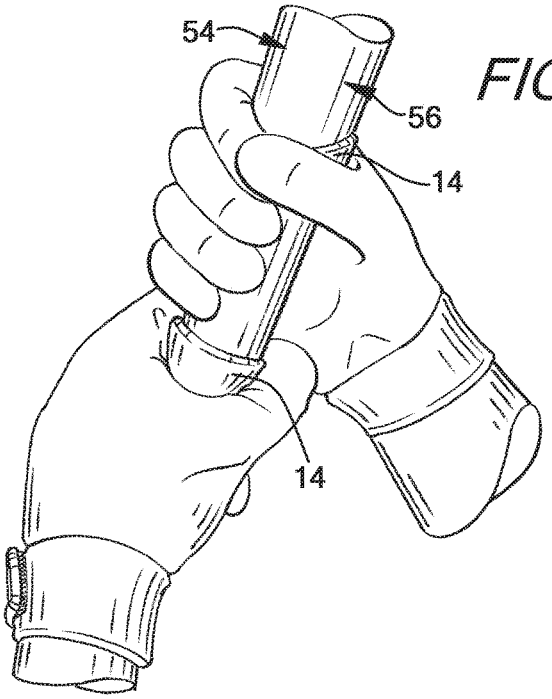
FIG. 9
FIG. 10A
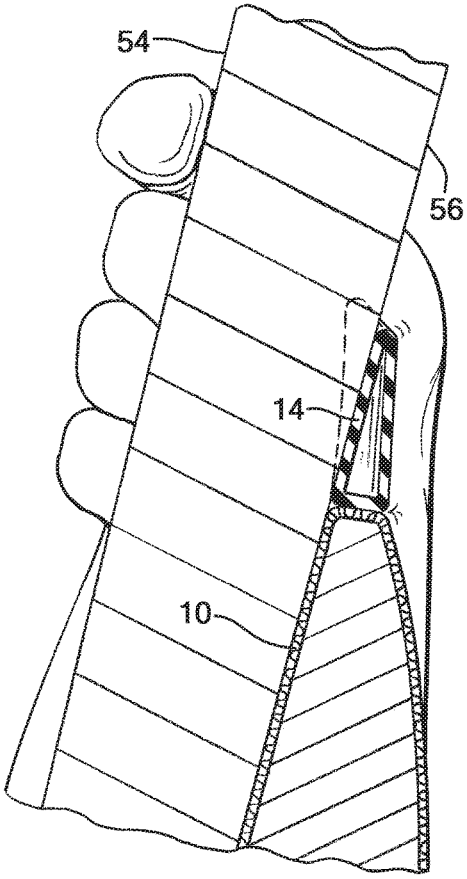
FIG. 10B
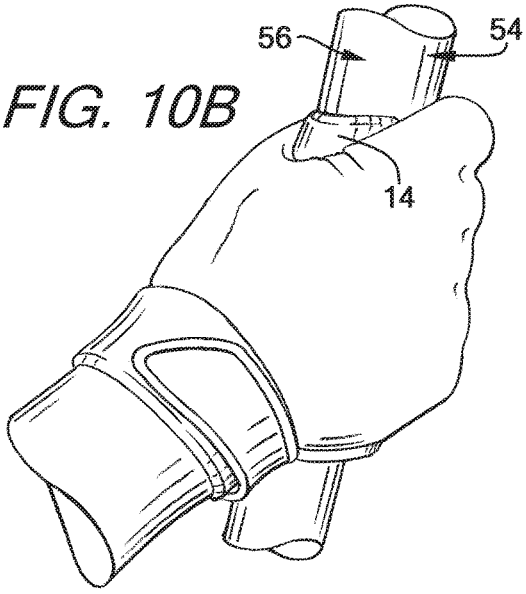

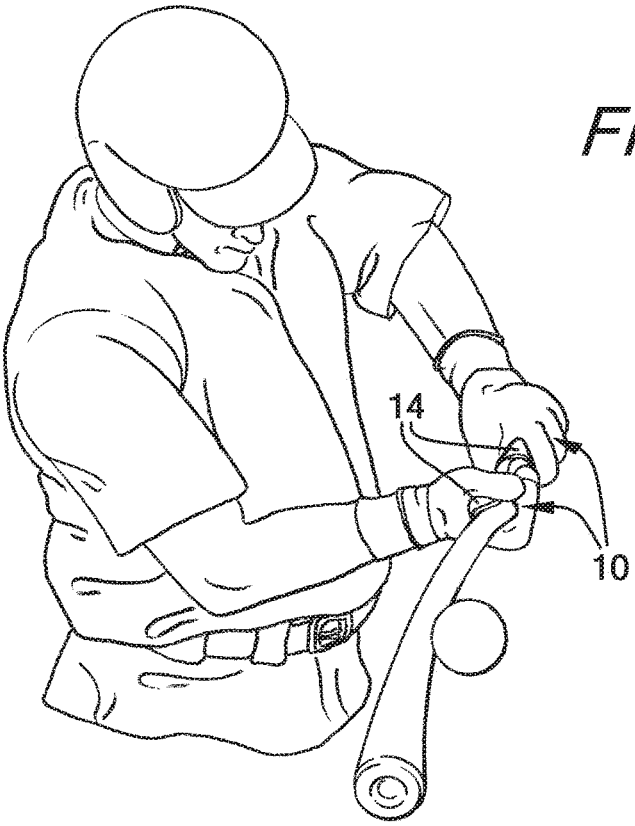
FIG. 11
FIG. 12
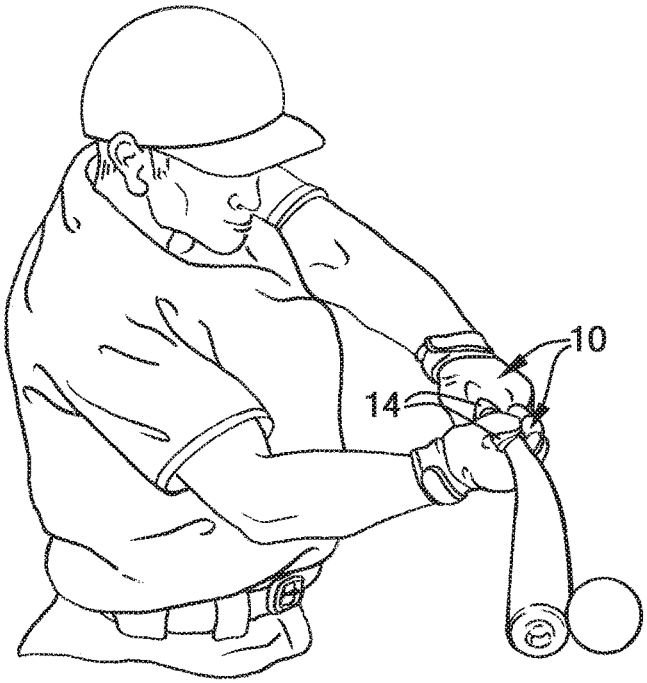

BATTING GLOVE AND CUSHIONING APPARATUS

CROSS-REFERENCE TO RELATED APPLICATIONS

The present application claims the benefit of U.S. patent application Ser. No. 62/099,352 filed on Jan. 2, 2015, which application is incorporated by reference herein.

FEDERALLY SPONSORED RESEARCH OR DEVELOPMENT

None

TECHNICAL FIELD

The invention relates generally to a protective glove for the human hand that is typically worn when playing sports that utilize hand-held implements or used in other activities and, more particularly, to a batting glove having structures to enhance protection, comfort and grip of the wearer.

BACKGROUND OF THE INVENTION

Athletic gloves for the protection and performance of the human hand in sports are known in the art. Athletes often wear such gloves when playing sports that require the use of hand-held implements such as baseball/softball bats, golf clubs, tennis racquets, racquetball racquets, and sticks such as hockey sticks and lacrosse sticks. Repetitive use of such implements can subject the athlete's hands to stress from impacts with a ball or puck wherein force impacts propagate into the hands. For example, a baseball player who repetitively hits baseballs can often experience soreness or pain in the hand, especially in the webbing area between the thumb and forefinger of the hand, sometimes referred to as the thenar region or thenar space. The soreness or pain may particularly be in the thenar region of the "top hand" of the player, e.g., the right hand for a right-handed batter and the left hand for a left-handed batter. Such soreness or pain in the thenar region can also be experienced when the batter hits a ball more towards the hands of the batter, e.g., being jammed, such as shown in FIG. 1. An athlete may also experience pain or discomfort in the fingers of the hands such as when the batter hits a ball towards the end of the bat such as shown in FIG. 2. In such occurrence, the bat will overly vibrate causing discomfort in the fingers. These bat/ball contact points often subject the hand to targeted stress in the thenar region as schematically shown in FIG. 1 and in the fingers as schematically shown in FIG. 2. The stress can also propagate throughout the hand including tissues and muscles. Such stress can be heightened if the player experiences multiple impact occurrences during the course of a game or consistent impact occurrences without sufficient recovery time. This stress results in soreness and pain that can linger in the athlete's hand over the course of a season. Consequently, the player's performance and overall enjoyment of the game is adversely affected. This phenomena can also be experienced in other circumstances such as when gripping bicycling handlebars. For example, a rider can experience repeated jolts and jarring to the hands during mounting biking or prolonged stresses when gripping road bike handlebars during long road rides.

While athletic gloves such as batting gloves according to the prior art, provide a number of advantageous features, they nevertheless have certain limitations. Existing batting glove designs incorporate padding that is positioned over various portions of the hand. Designs that sufficiently and efficiently minimize impact to the thenar region of the hand while not sacrificing comfort, grip or other performance have nevertheless been seriously lacking. The present invention is provided to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention provides an athletic glove such as a batting glove having a cushioning element or padding element configured to protect the webbing area of the hand between the thumb and forefinger, often referred to as the thenar region of the hand.

According to a first aspect of the invention, a batting glove is provided having a cover member defining a central opening and a plurality of finger elements and a thumb element. The batting glove has a web member positioned between the thumb element and a forefinger element. The web member minimizes force against a thenar region of a wearer's hand from a bat in response to an impact from hitting a ball with the bat.

According to another aspect of the invention, a batting glove has a cover member having a central opening and plurality of finger elements including a forefinger element and a thumb element configured to receive respective fingers and thumb of a user. A web space is between the forefinger element and the thumb element. The batting glove has a web member having a first portion connected proximate a finger element and a second portion connected proximate the thumb element. The web member is positioned in the web space.

According to a further aspect of the invention, the cover member has a curved segment extending from proximate the forefinger element to proximate the thumb element. The web member has a curved portion generally corresponding to the curved segment of the cover member. The curved portion of the web member is connected to the curved segment of the cover member.

According to another aspect of the invention, the web member has a pocket configured to receive cushioning inserts. The cushioning inserts can take the form of foam rubber, gels, putty or inflatable members.

According to a further aspect of the invention, the web member has extended segments to cover portions of the forefinger element and thumb element of the batting glove.

According to another aspect of the invention, the web member is configured to be removably attached to the batting glove.

According to another aspect of the invention, a cushioning apparatus protects against force impacts generated in response to hitting a ball with a baseball bat. The apparatus has a generally annular band in a first configuration wherein the band is dimensioned to be capable of being worn on a wrist. The apparatus also has a fastener operably connected to the band wherein the fastener is activated to place the band in a second configuration wherein a first portion of the band is connected to a second portion of the band to define a pad segment and wherein a first opening and a second opening are defined in the band. The first opening is dimensioned to receive a forefinger of a user and the second opening is dimensioned to receive a thumb of the user and wherein the pad segment is configured to be positioned adjacent a thenar region of the user.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 1 is a partial perspective view of a baseball player swinging a bat and hitting a ball towards a central portion of the bat;

FIG. 2 is a partial perspective view of a baseball player swinging a bat and hitting a ball towards an end of the bat;

FIG. 6 is a side elevation view of the batting glove shown in FIG. 5;

FIG. 7 is another side elevation view of the batting glove in FIG. 5;

FIG. 8 is an underside perspective view of the batting glove shown in FIG. 5 and also showing an alternative embodiment feature of the invention;

FIG. 9 is a perspective view of a wearer of the batting gloves of FIG. 3 and gripping a bat;

FIG. 10A is a schematic partial cross-sectional view of a user wearing the batting glove of FIG. 3 and gripping a handle of a baseball bat;

FIG. 10B is a perspective view of the wearer of the right hand glove and gripping a bat;

FIG. 11 is a partial perspective view of a baseball player wearing the batting gloves of FIG. 3, swinging a bat and hitting a ball towards a central portion of the bat;

FIG. 12 is a partial perspective view of a baseball player wearing the batting gloves of FIG. 3, swinging a bat and hitting a ball towards an end of the bat;

DETAILED DESCRIPTION OF THE PREFERRED EMBODIMENT

Figure 3:
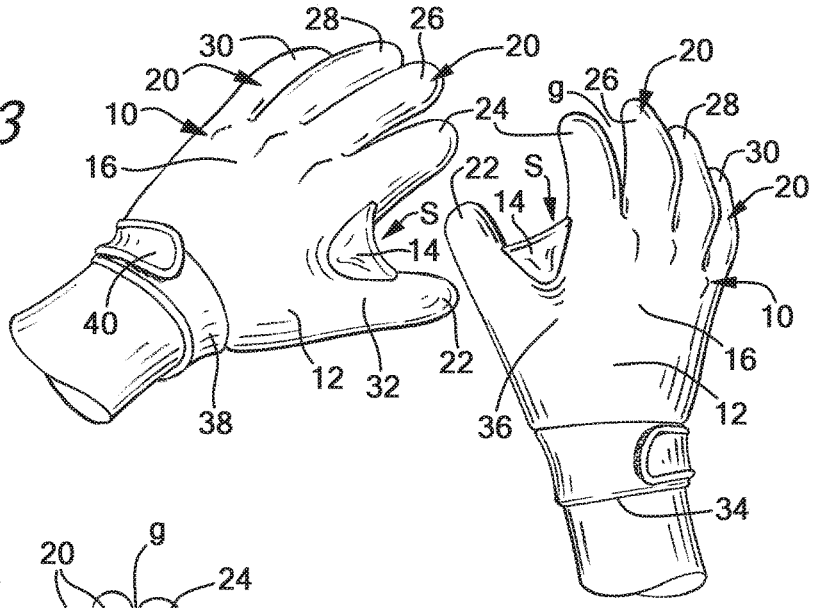
FIG. 3 is a top perspective view of a pair of batting gloves according to an exemplary embodiment of the present invention.

While this invention is susceptible of embodiments in many different forms, there are shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 4:
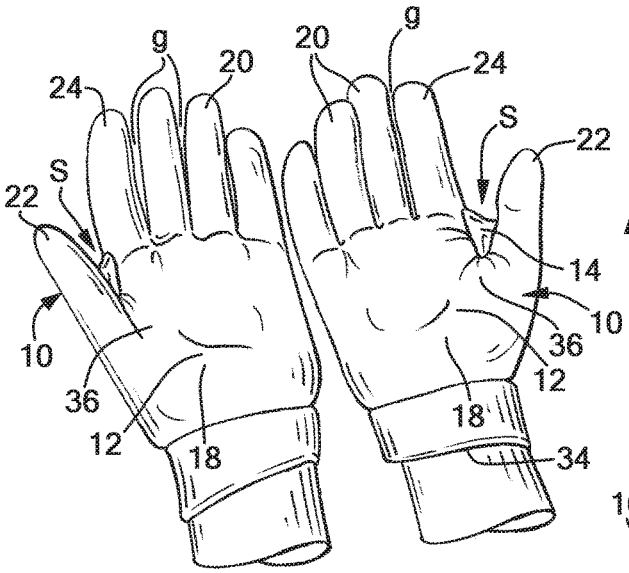
FIG. 4 is an underside perspective view of the pair of batting gloves shown in FIG. 3.
Figure 5:
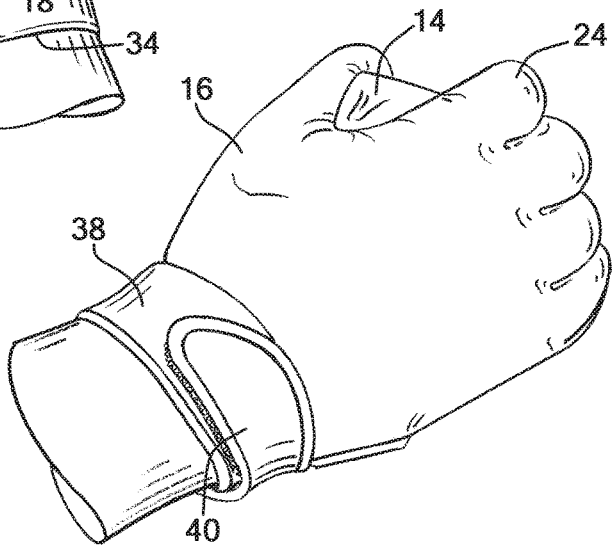
FIG. 5 is a perspective view of a right hand batting glove from the pair of batting gloves shown in FIG. 3.

Referring to the drawings, FIGS. 3 and 4 disclose a pair of athletic gloves in e form of baseball/softball batting gloves, and generally designated with the reference numeral 10. It is understood that the present invention is utilized in a single batting glove 10. In certain exemplary embodiments, an athlete may wear a glove 10 in each hand and wherein each glove 10 incorporates the invention. For simplicity, the invention will generally be described with respect to a single batting glove 10 with the understanding that the features described with respect to one glove 10 will be generally applicable to the other glove 10 as the structures and features are generally symmetrical between aright-hood batting glove and a left-hand batting glove.

As further shown in FIGS. 3-8, the batting glove 10 generally includes a cover member 12 and a web member 14, or web element 14, operably connected to the cover member 12. As explained in greater detail below, it is understood that the web member 14 may be considered an integral portion of the cover member 12 or separately connected to the cover member 12. The web member 14 may further be configured to be removably attached to the cover member 12.

Figure 8A:
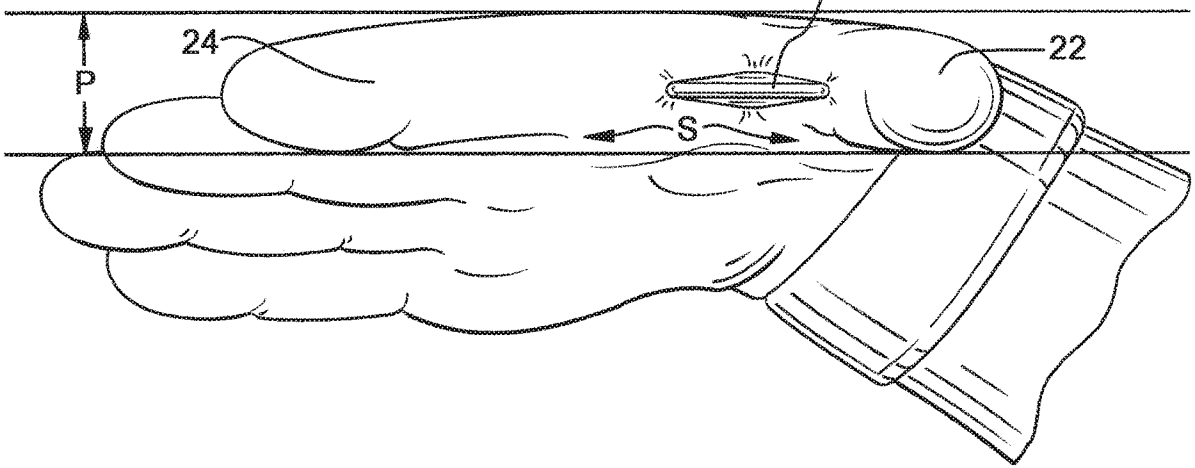
FIG. 8A is an end elevation view of the batting glove shown in FIG. 5 and showing a web element positioned between a forefinger element and a thumb element.

The cover member 12 is generally a typically constructed batting glove. Thus, the cover member 12 has a top portion 16 and a bottom portion 18 that cooperate to define additional parts of the batting glove 10 such as receiving portions or receiving stalls for receiving various portions of the hand. It is understood that the top portion 16 may be connected to the bottom portion such as by sewing to define a junction between the portions 16,18. The cover member 12 defines a plurality a finger elements 20 or finger sections 20 and a thumb element or thumb section 22. In particular, the finger elements 20 include a forefinger element 24, a middle finger or long finger element 26, a ring finger element 28 and a little finger element 30. The cover member 12 has gaps g generally located between the finger elements 28 as well as a web space S generally located between the forefinger element 24 and the thumb element 22, The web space S may also be referred to as a thenar space. The forefinger element 24 and thumb element 22 further define a curved segment 32 (FIGS. 6-8). In particular, an inner portion of the forefinger element 22 transitions to an inner portion of the thumb element 22 in a curved fashion and forms a generally U-shape or parabolic shape. The curved segment 32 includes the area defined at the juncture of the top portion 16 and the bottom portion 18 (e.g., a seam area generally from the forefinger element 24 and extending around to the thumb element 22. Thus, it is understood from FIGS. 3-8 that the top portion 16 may be sewn to the bottom portion 18 wherein the juncture of the portions 16,18 would generally be at a midpoint of the heights of the finger element as may be appreciated from FIG. 8A. The curved segment 32 is at the juncture of the top portion 16 and the bottom portion 18. Furthermore, the forefinger element 24 and thumb element 22 cooperatively define heights that generally define a plane P (FIG. 8A) wherein the web element 14 is generally positioned within the plane P as will be described in greater detail below. The top portion 16 is configured to cover a back of the hand and the bottom portion 18 is configured to cover a palm of the hand. The cover member 12 further defines a central opening 34 for entry of the hand when wearing the batting glove 10.

The top portion 16 and bottom portion 18 of the cover member 12 have confronting segments 36 that cover the thenar region of the wearer's hand. The curved segment 32 may be considered to also extend between the confronting segments 36 and into portions of the respective cover members 16,18 that cover the thenar region of a wearer's hand. In one exemplary embodiment, the confronting segment 36 of the bottom portion 18 is void of additional padding or cushioning and is merely comprised of the material of the cover member 12 at that location (FIG. 8). Alternatively, additional cushioning or padding could be used as well as at other areas of the cover member 12. It is further understood that the cover member 12 can be made from several different materials including leather or synthetic materials. The cover member 12 may be made from Spandex materials, materials, nylon materials, or other resilient materials, or combinations of such materials. For example, the bottom portion 18 may be made from leather or similar material while the top portion 16 may be made from elastic and breathable type materials. It is also understood that the inside of the cover member 12 may employ soft materials such as cotton at selected areas for additional comfort. It is further understood that the cover member 12 could include an elastic band 38 attached proximate the central opening 34, The elastic band 38 includes a fastener mechanism 40 typically in the form of a hook and loop fastener to wrap around a human wrist.

As further shown in FIGS. 3-8, the web member 14 is generally a flexible, elastic, resilient member in one exemplary embodiment. The web member 14 is generally positioned between the thumb element 22 and the forefinger element 24 and generally adjacent to the confronting segments 36 and portions 16,18 of the cover member 12. The web member 14 further occupies at least a portion of the web space S. In an exemplary embodiment, the web member 14 extends away from the curved segment 32 of the cover member 12 and extends substantially into the web space S. The web member 14 has a curved portion 42 that generally corresponds to the curved segment 32 defined by the outer portion of the forefinger element 24 and the thumb element 22, and is thus a U-shaped or parabolic shaped segment. The curved portion 42 may be considered to comprise a base portion 43 that is proximate to the cover member 12 of the glove 10. A distal, outer peripheral segment 44 of the web member 14 opposite the curved portion 42 is generally a linear segment having a first end 46, or first portion, contacting the forefinger element 24 and a second end 48, or second portion 48, contacting the thumb element 22. These contact points can be proximate a midpoint of the thumb element 22 and just under a midpoint of the forefinger element 24. The web member 14 can vary in size wherein these contact points could extend to various points on the thumb element 22 and forefinger element 24. Generally, however, the web element 14 has a first portion connected to the forefinger element 24 and a second portion connected to the thumb element 22.

The curved portion 42 of the web element 14 is operably connected to the cover member 12 at the curved segment 32 of the cover member 14. The operable connection can take many different forms including sewing, adhesives, heat bonding, welding or other types of fastening methods. In an exemplary embodiment, the web member 14 is connected at the juncture of the top portion 16 and bottom portion 18 of the cover member 12. Thus, the web member 14 extends into the web space S from this juncture that generally also defines the curved segment 32 of the cover member 12. As can be appreciated from FIG. 8A, the juncture may be generally proximate a midpoint of the respective heights of the forefinger element 24 and the thumb element 22. The web member 14 is dimensioned such that the web member 14 is in a generally planar or slightly curved relaxed state with the forefinger element and thumb element are at atypical distance apart represented such as when a hand is at a comfortable rested position. Accordingly, as shown in FIGS. 6-8, the web member 14 has a generally U-shape extending between the forefinger element 24 and the thumb element 22. The web member 14 may be considered to have the base portion 43 proximate the curved segment 32 of the cover member 12 of the glove 10 and the distal outer peripheral segment 44 opposite and remote from the base portion 43. It is further understood that in another exemplary embodiment, the web element 14 can have one portion connected to the thumb element and another portion connected to a finger element 20 that could include other finger elements such as the middle finger element 26, the ring finger element 28 or the little finger element 20, In addition to providing cushioning against the thenar region of the wearer's hand, such construction can minimize the sting sometimes experienced in the fingers such as when hitting a ball at an end of the baseball bat (FIGS. 2 and 12).

As discussed, the size of the web member 14 can vary wherein the farther along the web member 14 is connected to the forefinger element 24 and the thumb element 22 the larger the size of the web member 14. In certain exemplary embodiments, the distance from an apex area or base portion 43 of the curved portion 42 to the outer peripheral segment 44 could be approximately 1 inch. In a further exemplary embodiment, the distance may be 1⅛ inches. Other exemplary embodiments can have a distance from approximately ¼ inch to 2-3 inches. The web member 14 extends substantially into the web space S away from the curved segment 32 of the cover member 12. In additional exemplary embodiments, the central portion of the web member 14 may extend from approximately ¼ inch to approximately 1 inch, while outer portions of the web member 14 extend respectively further up on the forefinger element 24 and the thumb element 22. In such configuration, the web member 14 has a more pronounced, deeper and more narrow U-shape or parabolic shape. As discussed, the web member 14 extends into the web space S from the curved segment 32 at the juncture of the top portion 16 and the bottom portion 18. As discussed and shown in FIG. 8A, the forefinger element 24 and thumb element 22 define the plane 9 wherein the web element 14 is generally positioned within the plane P. The plane P could also be considered to correspond to the respective heights of the forefinger element 24 and thumb element 22 and wherein the web element 14 resides within the heights of the elements 22,24. The web element 14 further occupies the web space S in the plane P. Thus, the unique connection of the web element 14 to the cover member 12 (e.g., the connection of the curved portion 42 to the curved segment 32 generally at the juncture of the portions 16,18) provides for the extension of the web element 14 from the cover member 12 and positions the web element 14 in the plane P and web space S. The structure and configuration of the web element 14 and its operable connection to the cover member 12 provides benefits to the wearer regarding protection and comfort to the thenar region of the hand as described in greater detail below.

Figure 8C:
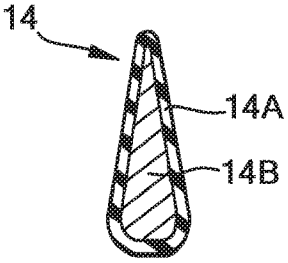
FIG. 8C is a schematic cross-sectional view of the web element that utilizes an inner layer and an outer layer.
Figure 8B:
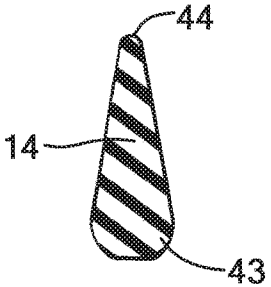
FIG. 8B is a schematic cross-sectional view of the web element of the present invention and having a variable thickness.

As further shown in FIGS. 6-8, the web member 14 may have a generally uniform thickness. In a further exemplary embodiment, the web member 14 may have a variable thickness. For example, as shown in FIG. 8B, the web member 14 may have a greater thickness proximate the base portion 43 where the thickness decreases towards the outer peripheral segment 44. This could also be reversed wherein the web member 14 has a greater thickness proximate the outer peripheral segment 44. Thickness configurations may depend on the particular desires of the athlete wearing the glove 10. In certain exemplary embodiments, the web member may have a thickness of approximately 0.060 inch. The thickness could be in a range of approximately 0.050 inch to approximately 0.25 inch.

The web member 14 further has a certain level of tackiness. In one exemplary embodiment, the web member may be considered "sticky" to the touch which will enhance performance as described in greater detail below. Thus, the web member 14 may be made from materials that provide a tacktified surface. The web member 14 may be considered to have frictional characteristics. Thus, the web member 14 may be made from materials having various hardness ranges and durometer properties.

In one exemplary embodiment, the web member 14 may be made from a composite or multi-layered material such as an elastic fabric base material covered by a vinyl material. Such composite material allows for a certain amount of stretch and resiliency, and the vinyl further allows for a certain amount of tackiness. As explained in greater detail below, this combination of characteristics allows for enhanced engagement with the handle of a baseball bat. FIG. 8C discloses an example of a multi-layered material used in the web element 14 in an exemplary embodiment of the invention. The web element 14 has an outer layer 14A that is made from a material that provides a tacktified surface such as a combination of silicone and neoprene in an exemplary embodiment. The web element 14 has an inner layer made of a leather material 14B that provides for a desired amount of elasticity but prevents overstretching. The outer layer 14A further promotes the desired amount of elasticity and further provides comfort, feel and grip enhancement for the implement being held such as the baseball bat. It is desirable for the web element 14 to stretch the desired amount and to further maintain its elastic properties throughout the useful life of the glove. It is further understood that the web member 14 could be made from a single layer of material that provides a tacktified surface.

The web member 14 may be made from other materials including but not limited to rubber, silicone, vinyl, other types of polymer materials as well as Spandex, Lycra and Nylon. Other synthetic polymers could also be used such as neoprene. It is also understood the size of the web member as well as the material can be selected to provide a desired amount of tension around a bat handle. It is further contemplated that the tension around the bat handle can be adjustable to customize the feel for the athlete. In one exemplary embodiment, the web element 14 is made from a silicone material, a neoprene material or a combination of silicone material and neoprene material. Such a combination can provide a tacktified surface. The element has a first member and a second member confronting the first member and defining a pocket between the members (FIG. 10A). This construction of the web element 14 shown in FIG. 10A provides an enhanced comfort level, cushioning level and grip enhancement to an athlete holding an implement such as a baseball bat. Alternatively, the web element can be a solid member (FIG. 8B). The web element 14 in this exemplary embodiment is connected to the cover member 12 as described above. In yet a further exemplary embodiment, the web member 14 could be a member generally resistant to stretching such as a leather member.

In a further exemplary embodiment, the web member 14 may define a pocket therein. The pocket can be filled with a variety of different inserts in the form of cushioning members having various thicknesses, hardness, resiliency and other desired properties. Thus, the inserts can have different levels of cushioning properties or durometers. The cushioning members could be rubber members, foam members, gel members, putty members, silicone members, air-filled pillows or inflatable bellows members. The web member 14 may define an opening 50 (FIG. 8) such as at the outer peripheral segment 44 wherein the cushioning member inserts 52 may be inserted through the opening and contained in the web member 14. In one exemplary embodiment, the insert 52 may be a silicone material having a generally soft durometer. In such configuration, the web member 14 can have various cushioning properties to be customized to the particular athlete's desires for protection, comfort and performance. It s understood that the pocket could extend to the junction of the cover member 16,18 or at the curved portion 42 or base portion 43. In yet another exemplary embodiment, it is understood that the web element 14, such as the construction shown in FIG. 10A, could be operably connected to an inflation device to provide a customized level of compressed air into the web element 14 to provide a cushioning member. The inflation device could be an external device but also be incorporated into the construction of the cover member 12 of the glove 10.

In use, a baseball player may typically wear a batting glove on each hand. As shown in FIGS. 9 and 10A-B, when holding and gripping the bat 54, the bat handle 56 rests generally in the palm portion of the hands and ideally, more towards where the fingers meet the palm. When the player grips the bat 56, the web member 14 smoothly wraps around the circumference of the bat handle 56. In an exemplary embodiment, there is a certain amount of stretch of the web member 14 around the bat handle 56. As further shown, the web member 14 is placed in a curved configuration and is in surface-to-surface contact with the bat handle 56. The web member 14 is not "scrunched" or unevenly pressed against the bat or hand. The web member 14 does not overlap upon itself when engaged with the baseball bat. Thus, the web member 14 is void of any creases, wrinkles or overlaps providing a comfortable grip of the bat 54. This smooth, surface-to-surface contact with the bat handle implement extends from the curved portion 42, or base portion 43, to the distal outer peripheral segment 44. The web member 14 forms a tight engagement against the bat handle 56. The connection of the web member 14 at the junction of the top portion 16 and bottom portion 18 and curved segment 32 assists in the web member 14 being in position to be comfortable against the bat handle implement and provide the cushioning and shock absorption as described herein. In addition, the tackiness of the web member 14 assists in providing a firm grip of the bat 54. The material selection for the web member 14 further provides for a proper amount of stretching around the bat handle 56 and enhanced gripping of the bat handle 56, In this configuration, the web member 14 is also placed against the thenar region of the hand. This configuration can be appreciated from FIG. 10A wherein the web element 14 provides an intermediary between the bat handle and the wearer's hand. As further can be appreciated from FIGS. 10A and 11-12, the web member 14 minimizes, cushions and dissipates force created in response to the player swinging the bat 54 and hitting a ball with the bat. Because of the material construction of the web member 14 and smooth planar-to-planar contact between the web member 14 and the handle 56 of the baseball bat 54, the player experiences a good comfortable grip that also minimizes force impacts into the thenar region of the hand from hitting a ball with the bat 56. For example, as shown in FIGS. 11 and 12, the web member 14 provides comfortable cushioning to thenar regions of the hands when hitting a ball even if the athlete is "jammed" (FIG. 11) and further provides comfortable cushioning if the athlete hits the ball at the end of the bat (FIG. 12).

Figure 13:
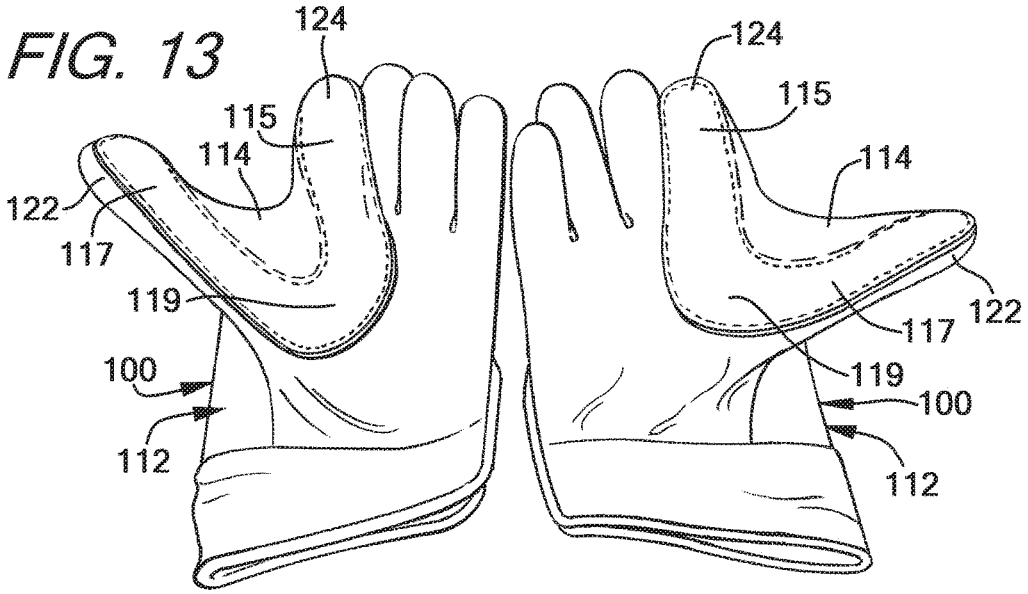
FIG. 13 is a top perspective view of a pair of batting gloves according to an alternative exemplary embodiment of the present invention.
Figure 14:
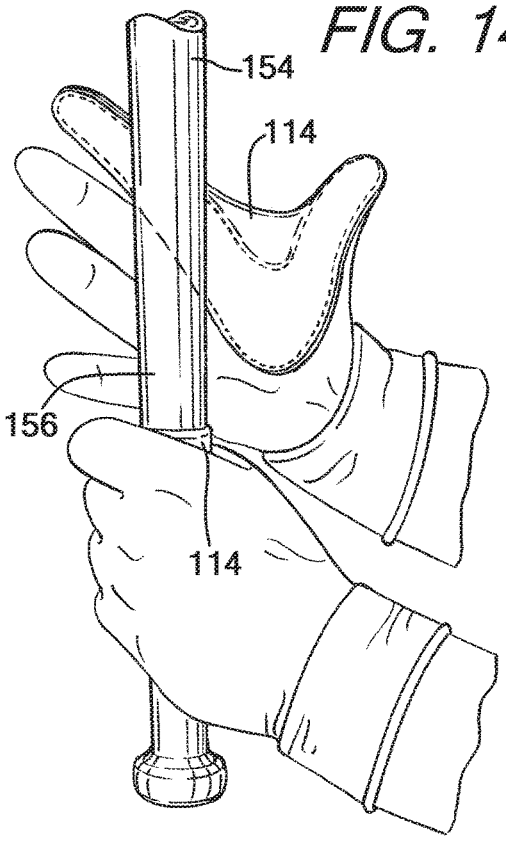
FIG. 14 is a partial perspective view of a wearer of the batting gloves shown in FIG. 13 gripping a bat.
Figure 15:
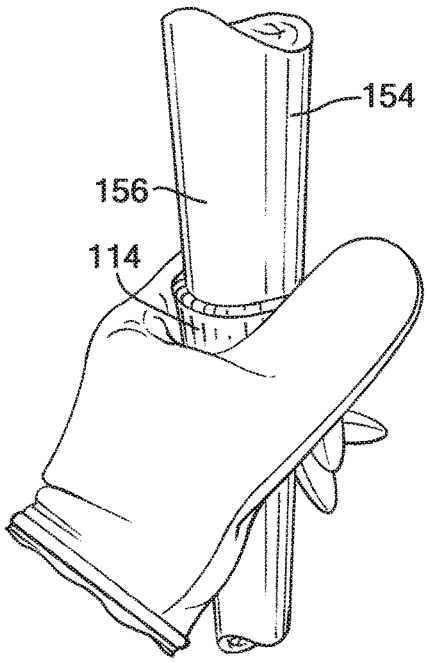
FIG. 15 is a perspective view of the wearer of the left hand glove and gripping a bat.

FIGS. 13-15 show another exemplary embodiment of batting gloves of the present invention. The batting gloves in FIGS. 13-15 are similar to the batting gloves in FIGS. 3-12, and like structures will be referenced with like reference numerals in a 100 series. Additional features of the batting gloves will be described further below.

As shown in FIG. 13, the batting gloves 100 have a cover element 112 and a web member 114. The web member 114 is similar to the web member 14 of FIGS. 3-12 and generally extends between the forefinger element 124 and the thumb element 122, The web member 114 has extended features wherein the web member 114 has a first extension portion 115 that extends over the forefinger element 124, a second extension portion 117 that extends over the thumb element 122, and a central extension portion 119 that extends further into the confronting elements of the cover element 112 that would correspond to the thenar region of the hand. In particular, the central extension portion 119 extends into palm area of the bottom portion 118 of the cover element 112.

Similar to the previous embodiment described above, the athlete wears the gloves 100 and grips an implement such as a baseball bat. As shown in FIGS. 14 and 15, the web member 114 wraps around the handle 156 of the baseball bat 154 wherein the web member 114 is in general surface-to-surface contact with the handle 156 of the baseball bat 154. Similar to the web element 14 of FIGS. 3-12, the web member 114 functions to minimize the force impacts to thenar regions of the hands created in response to the athlete swinging the bat and hitting a ball.

In the embodiments of the web member 14 of FIGS. 3-12 and the web member 114 of FIGS. 13-15, the web members 14,114 are generally integral with the batting gloves 10,100. It is understood that the web member 14,114 could be configured as a separate component that could be removably attached to the batting gloves 10,100.

FIGS. 16-23 disclose an additional exemplary embodiment of a cushioning apparatus or hand protection device designed to be used by an athlete such as when swinging a baseball bat to hit a ball. This embodiment is not an integral part of a batting glove, and is used either in conjunction with a batting glove or without a batting glove.

Figure 16:
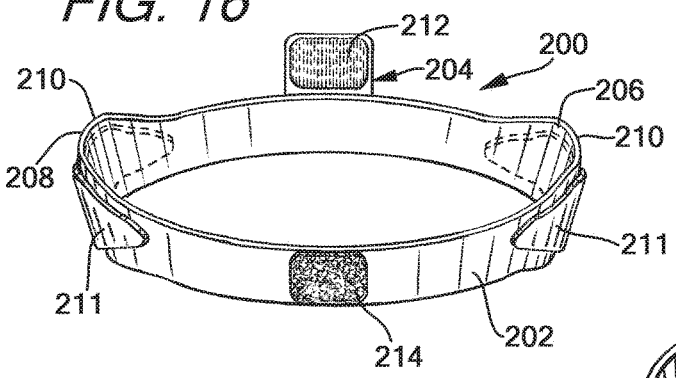
FIG. 16 is a perspective view of a cushioning apparatus according to another exemplary embodiment of the present invention.
Figure 18:
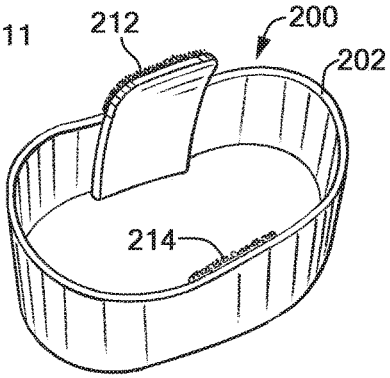
FIG. 18 is top perspective view of the cushioning apparatus and with a slightly larger band.
Figure 17:
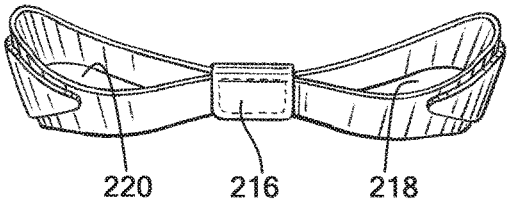
FIG. 17 is a perspective view of the cushioning apparatus of FIG. 16 shown in a fastened configuration.

FIGS. 16-23 disclose the embodiment of a cushioning apparatus of the present invention, generally designated with the reference numeral 200. As described in greater detail below, the cushioning apparatus 200 can be used on its own or in conjunction with a batting glove. As shown in FIGS. 16-18, the cushioning element 200 generally includes an annular band member 202 and a fastener 204, As explained in greater detail below, the cushioning element 200 is moveable between a first configuration that represents an annular ring-shaped configuration (FIG. 16) and a second configuration that represents a fastened configuration (FIG. 17).

As further shown in FIGS. 16-18, the annular band member 202 is in a ring-shape and dimensioned to be capable of being worn on a wrist of a user. It is understood that this annular, ring-shape represents the first configuration. The annular band member 202 has a first protrusion 206 and a second protrusion 208 located generally opposite the first protrusion 206, e.g., generally 180 degrees apart on the band member 202. The protrusions 206,208 have a curved peripheral surface 210. The annular band member 202 may have an additional pad member 211 located proximate each protrusion 206,208.

The cushioning apparatus 200 further has the fastener 204 operably connected to the annular band member 202. The fastener 204 has a first fastener member 212 located at first location on the annular band member 202. The fastener 204 also has a second fastener member 214 located at a second location on the annular band member 202, generally opposite the first location, e.g., generally 180 degrees apart on the band member 202, In one exemplary embodiment, the fastener 204 is a hook and loop fastener wherein one of the first fastener member 212 and the second fastener member 214 is a hook member and the other of the first fastener member 212 and the second fastener member 214 is a loop member. As will be described further, the first fastener member 212 is capable of being removably attached to the second fastener member 214. It is understood that the fastener 204 could take other forms including snaps, snap fit mechanisms, button arrangements, interference fits, sliding fasteners and other fastener types. It is understood that the fastener members 212,214 could be placed on outer portions of the band member 202 or inner portions of the band member 202.

Figure 19:
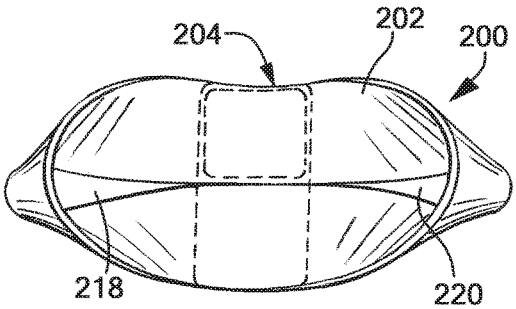
FIG. 19 is a perspective view of the cushioning apparatus in the fastened configuration.
Figure 20:
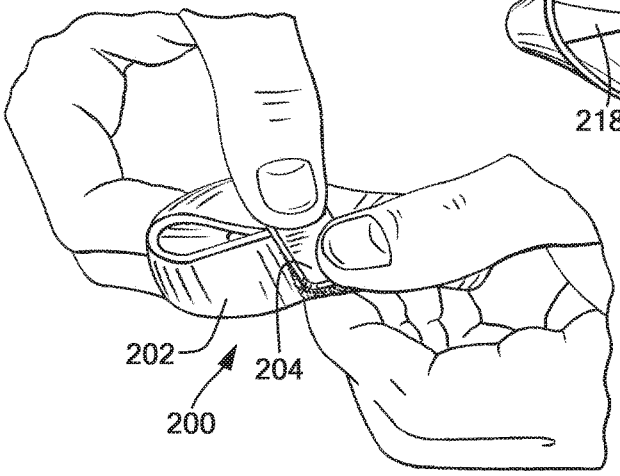
FIG. 20 is a perspective view the cushioning apparatus being placed in a fastened configuration.
Figure 21:
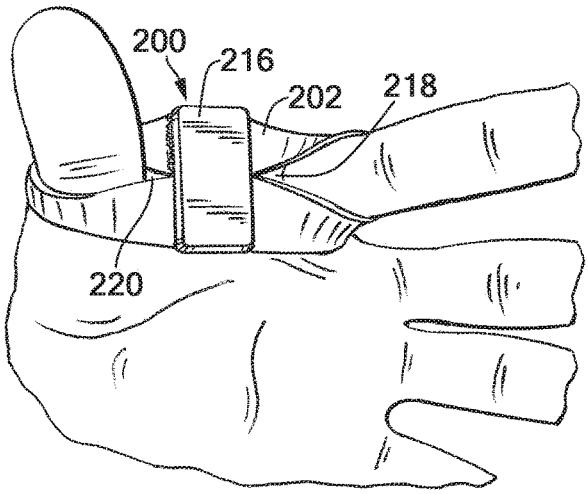
FIG. 21 is a perspective view of the cushioning apparatus in the fastened configuration and worn by a wearer.
Figure 22:
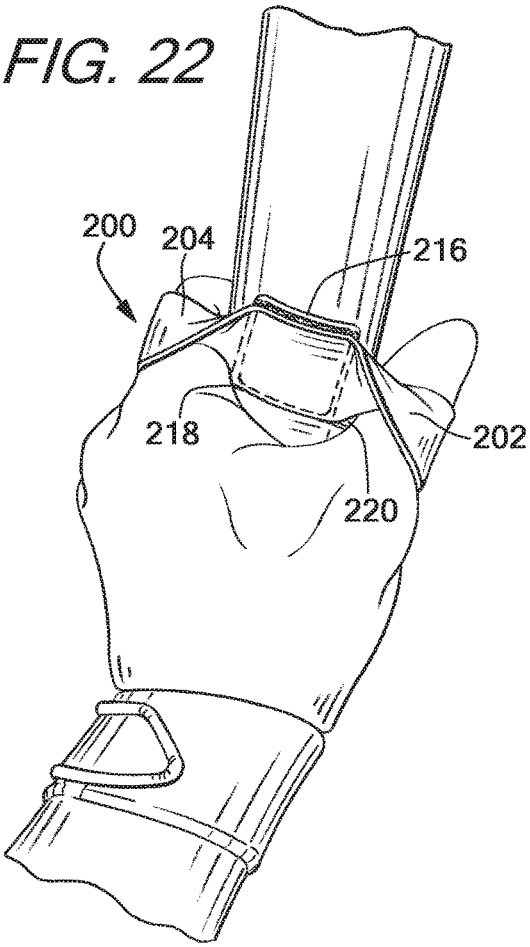
FIG. 22 is a partial perspective view of a wearer with a batting glove and with the cushioning apparatus worn over a batting glove and the wearer gripping a bat.
Figure 23:
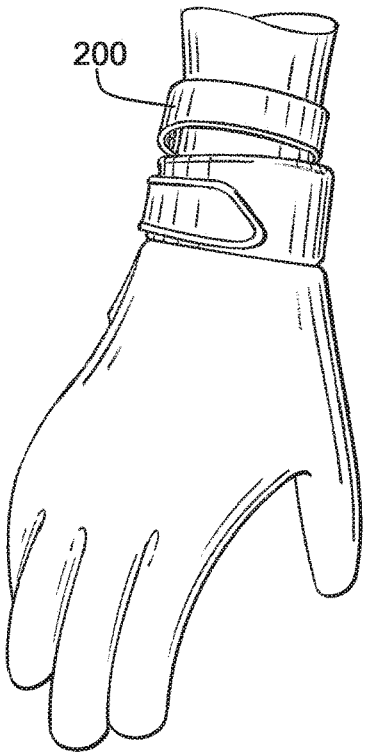
FIG. 23 is a perspective view of the cushioning apparatus in an annular configuration and worn on a wrist of the wearer.

As shown in FIG. 23 and can be appreciated from FIGS. 16 and 18, the annular band member 202 has the first configuration wherein the band member 202 is worn on the wrist of the user. FIGS. 17 and 19-22 show the band in the second configuration that represents a fastened configuration. Thus, a user activates the fastener 204 and places the first fastener member 212 in contact with the second fastener member 214 to connect the members 212,214. Thus, a first portion of the band 202 is connected to a second portion of the band 202. This connection defines a pad segment 216. The connection further defines a first opening 218 and a second opening 220 in the band 202. In use as shown in FIG. 21, the first opening 218 is dimensioned to receive to receive a forefinger of a user and the second opening 220 is dimensioned to receive a thumb of the user and wherein the pad segment 216 is configured to be positioned adjacent a thenar region of the user and the skin connecting the forefinger and the thumb. As can be appreciated from the discussion above and from FIG. 22, the cushioning apparatus 200 can also be worn over a traditional batting glove wherein the pad segment 216 would engage the surface of the bat handle and minimize force impacts created in response to the user swinging the bat and hitting a ball. In this configuration, the pad segment 216 is placed against the surface of the bat handle. When the user is done hitting a ball, the apparatus 200 can be returned to the first configuration Wherein the fastener members 212,214 are separated and the annular band member is in ring form. The apparatus 200 can then be worn comfortably on the wrist as shown in FIG. 23, It is appreciated that the pad segment 216 can take different configurations when the band 202 is in the fastened configuration such as shown in FIG. 17 and FIG. 19. Regardless, the pad segment 216 is configured to engage the handle of the bat and protect the thenar region of the wearer's hand. It is further understood that the pad segment 216 could be designed to have a pocket to receive additional cushioning inserts such as described above. The apparatus 200 may be dimensioned to accommodate different sizes of fingers and thumbs of different users. The material in the apparatus 200 can be any suitable flexible material, including but not limited to, silicone, polyurethane, polyethylene, elastic, spandex, rubber, latex, plastics, cotton, polyester, leather or any combination thereof. As discussed, the apparatus 200 can be used over a hand without wearing a batting glove.

In further exemplary embodiments, various types of sensors could be incorporated into the gloves 10, 100 or the cushioning device 200 disclosed herein. Sensors such as accelerometers or force sensors could be incorporated into the web element or other portions of the devices. The sensors could be utilized to indicate bat speed or the level of force incurred at the web element or against the thenar region of the hand.

The cushioning apparatus in the form of the batting glove of the present invention provides several benefits, First, the batting glove minimizes or takes stress off selected parts of the human hand, particularly in the thenar region of the hand. This may include the tissue generally between the forefinger and thumb and part of the palm and including the main thenar muscles, namely the abductor pollicis, brevis the flexor pollicis brevis and the opponens pollicis. Thus, the batting glove protects the wearer from injury from distributed shocks and impacts that occur in response to hitting a pitched ball with a bat, especially from repetitive swinging of the bat in hitting pitched balls. As shown for example in FIGS. 11-12, the web member wraps around the bat handle in surface-to-surface contact void of any creases or folds. This provides an efficient and comfortable cushioning effect for the thenar region of the user's hand. The web element is uniquely connected to the cover member that assists in allowing the web element to get into the desired position against the bat. The web element is connected at the junction of the top and bottom cover portions allowing the web element to reside in the web space S between the forefinger element and thumb element. Thus connection further allows the web element to reside in the plane P collectively defined by the forefinger element and thumb element rather than in a position above or below the plane P such as if the web element was connected on top or underneath the forefinger and thumb elements. The unique connection disclosed herein provides for the enhanced comfortable feel against the handle of the bat and the resulting enhanced cushioning effects of the web member. The construction also can minimize the discomfort experienced in the fingers, i.e., stinging in the fingers, from excessive bat vibration.

Upon considerable testing by the inventors herein, it has been found that this cushioning configuration of the web element is most comfortable for a user. It has been found that the configuration provides a natural feel when holding the bat while providing enhanced cushioning. It has further been found that in this cushioning configuration, any additional padding in the palm area of the batting glove is unnecessary. Indeed, the testing has determined that many players prefer to have less padding specifically at the thenar region of the palm as it provides a better "feel" of the bat in the hands of the user. Because of the seamless construction of the web member into the batting glove, the batting glove is easily worn under a fielder's glove as players often like to wear a batting glove in the fielder's glove when playing the field. In addition, the web member is integral with the batting glove eliminating the need for other separate devices to cushion the hand. For example, some players use a portable pad design that has a ring portion that fits over the thumb. These devices, however, are cumbersome and often do not provide a stable feel for the player. In addition, the device must be carried separately and used in conjunction with the batting glove. The web member of the present invention is a seamless, integral component of the batting glove. The batting gloves further reduce the overall wear and tear on the hands of the athlete. The batting gloves having the web member further aid in natural hand alignment on the bat and aids in keeping the hands in place once initially properly positioned. The batting gloves further promote increased bat speed and ball exit speed.

The cushioning apparatus of FIGS. 16-23 also provides several benefits. The cushioning apparatus also minimizes force impacts to the thenar region of the hand like the batting gloves of FIGS. 3-15. The wristband cushioning apparatus can also be removably attached to a batting glove as desired. A player can wear the wristband on the wrist in the unfastened configuration when the player is not hitting. The player can easily remove the wristband and change to the fastened configuration to be worn on the forefinger and thumb such as over a batting glove to provide cushioning when hitting. Furthermore, after an at-bat, the player can quickly remove the apparatus from the batting glove and again wear the apparatus on the wrist. The cushioning apparatus can also be worn under a fielder's glove to provide cushioning when playing the field.

As discussed above, the invention is particularly applicable to batting gloves for baseball players swinging a bat and hitting baseballs. The invention is equally applicable to softball batting gloves including girls fastpitch batting gloves. The invention can also be incorporated into other types of gloves intended for use in various other activities including golf, tennis, racquetball, hockey and lacrosse or any other sports utilizing hand-held implements. The invention could be incorporated into football-related gloves. The invention could further be incorporated into cycling gloves for gripping handlebars. The invention could further be incorporated into gloves for non-sports related activities such as gardening, farming, automotive or other activities. For example, the gloves could be helpful when performing other repetitive use activities such as raking with a rake or sweeping with a broom. The gloves could also help when climbing ladders.

While the invention has been described in its preferred embodiments, it is to be understood that the words which have been used are words of description rather than limitation and that changes may be made within the purview of the appended claims without departing from the true scope and spirit of the invention in its broader aspects.

What is claimed is:

1. A batting glove comprising: a cover member having a central opening and plurality of finger elements including a forefinger element and a thumb element configured to receive respective fingers and thumb of a user, the cover member having a top portion and a bottom portion configured to cover the respective fingers and thumb of the user wherein the finger elements have closed distal ends and the bottom portion further configured to cover a palm of the user's hand, wherein the cover member is configured to enclose an entire hand of a user, a web space defined between the forefinger element and the thumb element; and a web member having a first end connected proximate the forefinger element and under a midpoint of the forefinger element, and a second end connected proximate the thumb element at proximate a midpoint of the thumb element wherein the web member is positioned in the web space, the web member defining a base portion and further defining an outer peripheral segment opposite the base portion, wherein the outer peripheral segment extends across the web space from the first end to the second end, wherein the web member has a tapered thickness wherein the tapered thickness decreases from the base portion to the outer peripheral segment.

2. The batting glove of claim 1 wherein the web member is configured to engage a handle surface of a bat in response to a user gripping the bat and wherein the web member is configured to minimize force against a thenar region of a user's hand in response to the bat hitting a ball.

3. The batting glove of claim 1 wherein the web member is configured to engage a curved handle surface of a bat in response to a user gripping the bat wherein the web member is in a curved configuration and in surface-to-surface contact with the curved handle surface of the bat, and wherein the web member is void of any overlapping upon itself.

4. The batting glove of claim 1 wherein the cover member has a curved segment extending from proximate the forefinger element to proximate the thumb element, the web member having a curved portion corresponding to the curved segment of the cover member wherein the curved portion of the web member is connected to the curved segment of the cover member.

5. The batting glove of claim 1 wherein the cover member has a curved segment and the base portion is connected to the cover member at the curved segment.

6. The batting glove of claim 1 wherein the web member is generally parabolic in shape.

7. The batting glove of claim 1 wherein the web member is approximately one inch in length from the base portion to the outer peripheral segment of the web member.

8. The batting glove of claim 1 wherein the web member is elastic and configured to conform around a handle of a bat in response to a user gripping the handle of the bat.

9. The batting glove of claim 1 wherein the web member is made from a material having a tacktified surface.

10. The batting glove of claim 1 wherein the web member is a leather member resistant to stretching.

11. The batting glove of claim 1 wherein the web member has a thickness in the range of 0.05 inch to 0.25 inch.

12. The batting glove of claim 1 wherein the web member is a material combination of silicone and neoprene and provides an elastic member having a tacktified surface.

13. A batting glove comprising: a cover member having a central opening and plurality of finger elements including a forefinger element and a thumb element configured to receive respective fingers and a thumb of a user, the cover member having a top portion and bottom portion providing closed distal ends of the plurality of finger elements and the cover member being configured to cover an entire hand of the user, wherein the cover member further has a curved segment extending from the forefinger element to the thumb element, and a web space defined between the forefinger element and the thumb element; and a web member having a first end connected proximate the forefinger element and under a midpoint of the forefinger element, and a second end connected proximate the thumb element at proximate a midpoint of the thumb element, the web member defining a base portion having a curved portion corresponding to the curved segment of the cover member wherein the curved portion of the web member is connected to the curved segment of the cover member, the web member further having an outer peripheral segment opposite the base portion, wherein the web member has a tapered thickness wherein the tapered thickness decreases from the base portion to the outer peripheral segment, the outer peripheral segment of the web member positioned under the midpoint of the forefinger element and proximate the midpoint of the thumb element, wherein the web member is positioned in the web space, and wherein the outer peripheral segment extends across the web space from the first end to the second end, and wherein the web member is configured to engage a curved handle surface of a bat in response to a user gripping the bat wherein the web member occupies a curved configuration and is configured to be in surface-to-surface contact with the curved handle surface of the bat, wherein the web member is void of any overlapping upon itself, and wherein the web member is configured to minimize force against a thenar region of a user's hand in response to the bat hitting a ball.

* * * * *